US007882902B2

(12) United States Patent
Boutwell, Jr.

(10) Patent No.: US 7,882,902 B2
(45) Date of Patent: Feb. 8, 2011

(54) TOP DRIVE INTERLOCK

(75) Inventor: Doyle F. Boutwell, Jr., Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 265 days.

(21) Appl. No.: 11/940,661

(22) Filed: Nov. 15, 2007

(65) Prior Publication Data

US 2008/0125876 A1 May 29, 2008

Related U.S. Application Data

(60) Provisional application No. 60/866,322, filed on Nov. 17, 2006.

(51) Int. Cl.
*E21B 47/18* (2006.01)
*E21B 19/00* (2006.01)

(52) U.S. Cl. ..... 175/40; 175/85; 175/52; 166/379; 166/77.1; 166/78.1

(58) Field of Classification Search ..... 166/380, 166/77.51, 66, 379, 77.1, 78.1, 85.1; 175/40, 175/85, 52
See application file for complete search history.

(56) References Cited

U.S. PATENT DOCUMENTS

| | | | |
|---|---|---|---|
| 179,973 | A | 7/1876 | Thornton |
| 1,414,207 | A | 4/1922 | Reed |
| 1,418,766 | A | 6/1922 | Wilson |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,842,638 | A | 1/1932 | Wigle |
| 1,917,135 | A | 7/1933 | Littell |
| 2,105,885 | A | 1/1938 | Hinderliter |
| 2,128,430 | A | 8/1938 | Pryor |
| 2,167,338 | A | 7/1939 | Murcell |
| 2,184,681 | A | 12/1939 | Osmun et al. |
| 2,214,429 | A | 9/1940 | Miller |

(Continued)

FOREIGN PATENT DOCUMENTS

| | | |
|---|---|---|
| CA | 2 307 386 | 11/2000 |

(Continued)

OTHER PUBLICATIONS

GB Search Report, Application No. GB0722465.2, dated Feb. 2, 2008.

(Continued)

*Primary Examiner*—Jennifer H Gay
*Assistant Examiner*—Yong-Suk Ro
(74) *Attorney, Agent, or Firm*—Patterson & Sheridan, L.L.P.

(57) ABSTRACT

The present invention generally relates to methods and apparatus for improving top drive operations. A method of ensuring safe operation of a top drive includes operating a top drive, thereby exerting torque on a first tubular to makeup or breakout a first threaded connection between the first tubular and a second tubular. The method further includes monitoring for break-out of a second connection between a quill of the top drive and the first tubular; and stopping operation of the top drive and/or notifying an operator of the top drive if break-out of the second connection is detected.

23 Claims, 9 Drawing Sheets

U.S. PATENT DOCUMENTS

| | | | |
|---|---|---|---|
| 2,414,719 | A | 1/1947 | Cloud |
| 2,522,444 | A | 9/1950 | Grable |
| 2,536,458 | A | 1/1951 | Munsinger |
| 2,570,080 | A | 10/1951 | Stone |
| 2,582,987 | A | 1/1952 | Hagenbook |
| 2,595,902 | A | 5/1952 | Stone |
| 2,610,690 | A | 9/1952 | Beatty |
| 2,641,444 | A | 6/1953 | Moon |
| 2,668,689 | A | 2/1954 | Cormany |
| 2,692,059 | A | 10/1954 | Bolling, Jr. |
| 2,953,406 | A | 9/1960 | Young |
| 2,965,177 | A | 12/1960 | Bus, Sr. et al. |
| 3,041,901 | A | 7/1962 | Knights |
| 3,087,546 | A | 4/1963 | Wooley |
| 3,122,811 | A | 3/1964 | Gilreath |
| 3,191,683 | A | 6/1965 | Alexander |
| 3,193,116 | A | 7/1965 | Kenneday et al. |
| 3,266,582 | A | 8/1966 | Homanick |
| 3,305,021 | A | 2/1967 | Lebourg |
| 3,321,018 | A | 5/1967 | McGill |
| 3,380,528 | A | 4/1968 | Timmons |
| 3,392,609 | A | 7/1968 | Bartos |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,566,505 | A | 3/1971 | Martin |
| 3,570,598 | A | 3/1971 | Johnson |
| 3,602,302 | A | 8/1971 | Kluth |
| 3,606,664 | A | 9/1971 | Weiner |
| 3,635,105 | A | 1/1972 | Dickmann et al. |
| 3,638,989 | A | 2/1972 | Sandquist |
| 3,662,842 | A | 5/1972 | Bromell |
| 3,680,412 | A | 8/1972 | Mayer et al. |
| 3,691,825 | A | 9/1972 | Dyer |
| 3,697,113 | A | 10/1972 | Palauro et al. |
| 3,700,048 | A | 10/1972 | Desmoulins |
| 3,706,347 | A | 12/1972 | Brown |
| 3,746,330 | A | 7/1973 | Taciuk |
| 3,747,675 | A | 7/1973 | Brown |
| 3,766,991 | A | 10/1973 | Brown |
| 3,776,320 | A | 12/1973 | Brown |
| 3,780,883 | A | 12/1973 | Brown |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,957,381 | A | 5/1976 | Schafer |
| 3,961,399 | A | 6/1976 | Boyadjieff |
| 3,964,552 | A | 6/1976 | Slator |
| 3,980,143 | A | 9/1976 | Swartz et al. |
| 3,998,563 | A | 12/1976 | Kloren |
| 4,010,669 | A | 3/1977 | Kloren |
| 4,025,213 | A | 5/1977 | Schafer et al. |
| 4,054,332 | A | 10/1977 | Bryan, Jr. |
| 4,077,525 | A | 3/1978 | Callegari et al. |
| 4,095,908 | A | 6/1978 | Schafer et al. |
| 4,100,968 | A | 7/1978 | Delano |
| 4,127,927 | A | 12/1978 | Hauk et al. |
| 4,134,699 | A | 1/1979 | Schafer et al. |
| 4,142,739 | A | 3/1979 | Billingsley |
| 4,202,225 | A | 5/1980 | Sheldon et al. |
| 4,221,269 | A | 9/1980 | Hudson |
| 4,257,442 | A | 3/1981 | Claycomb |
| 4,260,142 | A | 4/1981 | Stiefel et al. |
| 4,262,693 | A | 4/1981 | Giebeler |
| 4,262,887 | A | 4/1981 | Jansen |
| 4,262,888 | A | 4/1981 | Jansen et al. |
| 4,274,777 | A | 6/1981 | Scaggs |
| 4,274,778 | A | 6/1981 | Putnam et al. |
| 4,280,380 | A | 7/1981 | Eshghy |
| 4,282,979 | A | 8/1981 | Friedrichs |
| 4,315,553 | A | 2/1982 | Stallings |
| 4,320,915 | A | 3/1982 | Abbott et al. |
| 4,401,000 | A | 8/1983 | Kinzbach |
| 4,428,565 | A | 1/1984 | Stiefel et al. |
| 4,437,363 | A | 3/1984 | Haynes |
| 4,440,220 | A | 4/1984 | McArthur |
| 4,446,745 | A | 5/1984 | Stone et al. |
| 4,449,596 | A | 5/1984 | Boyadjieff |
| 4,472,002 | A | 9/1984 | Beney et al. |
| 4,489,794 | A | 12/1984 | Boyadjieff |
| 4,492,134 | A | 1/1985 | Reinhldt et al. |
| 4,494,424 | A | 1/1985 | Bates |
| 4,515,045 | A | 5/1985 | Gnatchenko et al. |
| 4,529,045 | A | 7/1985 | Boyadjieff et al. |
| 4,570,706 | A | 2/1986 | Pugnet |
| 4,592,125 | A | 6/1986 | Skene |
| 4,593,584 | A | 6/1986 | Neves |
| 4,593,773 | A | 6/1986 | Skeie |
| 4,604,724 | A | 8/1986 | Shaginian et al. |
| 4,604,818 | A | 8/1986 | Inoue |
| 4,605,077 | A | 8/1986 | Boyadjieff |
| 4,613,161 | A | 9/1986 | Brisco |
| 4,625,796 | A | 12/1986 | Boyadjieff |
| 4,646,827 | A | 3/1987 | Cobb |
| 4,649,777 | A | 3/1987 | Buck |
| 4,652,195 | A | 3/1987 | McArthur |
| 4,660,811 | A | 4/1987 | Muhlhahn et al. |
| 4,667,752 | A | 5/1987 | Berry et al. |
| 4,676,312 | A | 6/1987 | Mosing et al. |
| 4,681,158 | A | 7/1987 | Pennison |
| 4,681,162 | A | 7/1987 | Boyd |
| 4,683,962 | A | 8/1987 | True |
| 4,686,873 | A | 8/1987 | Lang et al. |
| 4,709,599 | A | 12/1987 | Buck |
| 4,709,766 | A | 12/1987 | Boyadjieff |
| 4,725,179 | A | 2/1988 | Woolslayer et al. |
| 4,735,270 | A | 4/1988 | Fenyvesi |
| 4,738,145 | A | 4/1988 | Vincent et al. |
| 4,742,876 | A | 5/1988 | Barthelemy et al. |
| 4,759,239 | A | 7/1988 | Hamilton et al. |
| 4,762,187 | A | 8/1988 | Haney |
| 4,765,401 | A | 8/1988 | Boyadjieff |
| 4,765,416 | A | 8/1988 | Bjerking et al. |
| 4,773,689 | A | 9/1988 | Wolters |
| 4,781,359 | A | 11/1988 | Matus |
| 4,791,997 | A | 12/1988 | Krasnov |
| 4,793,422 | A | 12/1988 | Krasnov |
| 4,800,968 | A | 1/1989 | Shaw et al. |
| 4,813,493 | A | 3/1989 | Shaw et al. |
| 4,813,495 | A | 3/1989 | Leach |
| 4,821,814 | A | 4/1989 | Willis et al. |
| 4,832,552 | A | 5/1989 | Skelly |
| 4,836,064 | A | 6/1989 | Slator |
| 4,843,945 | A | 7/1989 | Dinsdale |
| 4,854,383 | A | 8/1989 | Arnold et al. |
| 4,867,236 | A | 9/1989 | Haney et al. |
| 4,875,530 | A | 10/1989 | Frink et al. |
| 4,878,546 | A | 11/1989 | Shaw et al. |
| 4,899,816 | A | 2/1990 | Mine |
| 4,909,741 | A | 3/1990 | Schasteen et al. |
| 4,921,386 | A | 5/1990 | McArthur |

4,936,382 A 6/1990 Thomas
4,962,579 A 10/1990 Moyer et al.
4,962,819 A 10/1990 Bailey et al.
4,971,146 A 11/1990 Terrell
4,997,042 A 3/1991 Jordan et al.
5,022,472 A 6/1991 Bailey et al.
5,036,927 A 8/1991 Willis
5,049,020 A 9/1991 McArthur
5,060,542 A 10/1991 Hauk
5,062,756 A 11/1991 McArthur et al.
5,081,888 A 1/1992 Schulze-Beckinghausen
5,083,356 A 1/1992 Gonzalez et al.
5,107,940 A 4/1992 Berry
5,111,893 A 5/1992 Kvello-Aune
RE34,063 E 9/1992 Vincent et al.
5,161,438 A 11/1992 Pietras
5,191,939 A 3/1993 Stokley
5,207,128 A 5/1993 Albright
5,233,742 A 8/1993 Gray et al.
5,245,265 A 9/1993 Clay
5,251,709 A 10/1993 Richardson
5,255,751 A 10/1993 Stogner
5,272,925 A 12/1993 Henneuse et al.
5,282,653 A 2/1994 LaFleur et al.
5,284,210 A 2/1994 Helms et al.
5,294,228 A 3/1994 Willis et al.
5,297,833 A 3/1994 Willis et al.
5,305,839 A 4/1994 Kalsi et al.
5,332,043 A 7/1994 Ferguson
5,340,182 A 8/1994 Busink et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tassari et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,667,026 A 9/1997 Lorenz et al.
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,189,621 B1 2/2001 Vail, III
6,199,641 B1 3/2001 Downie et al.
6,202,764 B1 3/2001 Ables et al.
6,217,258 B1 4/2001 Yamamoto et al.
6,227,587 B1 5/2001 Terral
6,237,684 B1 5/2001 Bouligny, Jr. et al.
6,274,211 B1 8/2001 Detzner
6,276,450 B1 8/2001 Seneviratne
6,279,654 B1 8/2001 Mosing et al.
6,309,002 B1 10/2001 Bouligny
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,415,862 B1 7/2002 Mullins
6,431,626 B1 8/2002 Bouligny
6,443,241 B1 9/2002 Juhasz et al.
6,527,047 B1 3/2003 Pietras
6,527,493 B1 3/2003 Kamphorst et al.
6,536,520 B1 3/2003 Snider et al.
6,553,825 B1 4/2003 Boyd
6,571,868 B2 6/2003 Victor
6,591,471 B1 7/2003 Hollingsworth et al.
6,595,288 B2 7/2003 Mosing et al.
6,622,796 B1 9/2003 Pietras
6,637,526 B2 10/2003 Juhasz et al.
6,651,737 B2 11/2003 Bouligny
6,668,684 B2 12/2003 Allen et al.
6,668,937 B1 12/2003 Murray
6,669,183 B2 12/2003 Detzner
6,679,333 B2 1/2004 York et al.
6,688,394 B1 2/2004 Ayling
6,688,398 B2 2/2004 Pietras
6,691,801 B2 2/2004 Juhasz et al.
6,695,559 B1 2/2004 Pietras
6,705,405 B1 3/2004 Pietras
6,725,938 B1 4/2004 Pietras
6,725,949 B2 4/2004 Seneviratne
6,732,822 B2 5/2004 Slack et al.
6,742,584 B1 6/2004 Appleton
6,742,596 B2 6/2004 Haugen
6,832,656 B2 12/2004 Cameron
6,832,658 B2 12/2004 Keast
6,840,322 B2 1/2005 Haynes
6,892,835 B2 5/2005 Shahin et al.
6,907,934 B2 6/2005 Kauffman et al.
6,913,096 B1 7/2005 Nielsen et al.
6,938,697 B2 9/2005 Haugen
6,976,298 B1 12/2005 Pietras
6,994,176 B2 2/2006 Shahin et al.
7,004,259 B2 2/2006 Pietras
7,028,586 B2 4/2006 Robichaux
7,044,241 B2 5/2006 Angman
7,073,598 B2 7/2006 Haugen
7,090,021 B2 8/2006 Pietras
7,096,977 B2 8/2006 Juhasz et al.
7,100,698 B2 9/2006 Kracik et al.
7,107,875 B2 9/2006 Haugen et al.
7,117,938 B2 10/2006 Hamilton et al.
7,128,161 B2 10/2006 Pietras

| | | | | |
|---|---|---|---|---|
| 7,140,443 | B2 | 11/2006 | Beierbach et al. | |
| 7,140,445 | B2 | 11/2006 | Shahin et al. | |
| 7,188,686 | B2 | 3/2007 | Folk et al. | |
| 7,191,840 | B2 | 3/2007 | Pietras et al. | |
| 7,213,656 | B2 | 5/2007 | Pietras | |
| 7,264,050 | B2 | 9/2007 | Koithan et al. | |
| 7,270,189 | B2 | 9/2007 | Brown et al. | |
| 7,296,623 | B2 | 11/2007 | Koithan et al. | |
| 7,325,610 | B2 | 2/2008 | Giroux et al. | |
| 7,568,522 | B2 | 8/2009 | Boutwell et al. | |
| 7,757,759 | B2 | 7/2010 | Jahn et al. | |
| 2001/0042625 | A1 | 11/2001 | Appleton | |
| 2002/0108748 | A1 | 8/2002 | Keyes | |
| 2003/0164276 | A1 | 9/2003 | Snider et al. | |
| 2003/0173073 | A1 | 9/2003 | Snider et al. | |
| 2004/0003490 | A1 | 1/2004 | Shahin et al. | |
| 2004/0144547 | A1* | 7/2004 | Koithan et al. | 166/380 |
| 2005/0000691 | A1 | 1/2005 | Giroux et al. | |
| 2005/0051343 | A1 | 3/2005 | Pietras et al. | |
| 2005/0269104 | A1 | 12/2005 | Folk et al. | |
| 2005/0274508 | A1 | 12/2005 | Folk et al. | |
| 2006/0000600 | A1 | 1/2006 | Pietras | |
| 2006/0124353 | A1 | 6/2006 | Juhasz et al. | |
| 2006/0180315 | A1 | 8/2006 | Shahin et al. | |
| 2007/0000668 | A1 | 1/2007 | Christensen | |
| 2007/0131416 | A1 | 6/2007 | Odell, II et al. | |

FOREIGN PATENT DOCUMENTS

| | | | |
|---|---|---|---|
| DE | 3 523 221 | | 2/1987 |
| EP | 0 087 373 | | 8/1983 |
| EP | 0 162 000 | | 11/1985 |
| EP | 0 171 144 | | 2/1986 |
| EP | 0 285 386 | | 10/1988 |
| EP | 0 474 481 | | 3/1992 |
| EP | 1148206 | | 10/2001 |
| EP | 1 256 691 | | 11/2002 |
| EP | 1 426 550 | | 6/2004 |
| EP | 1 659 258 | A3 | 5/2006 |
| GB | 2 053 088 | | 2/1981 |
| GB | 2 224 481 | | 9/1990 |
| GB | 2 275 486 | | 4/1993 |
| GB | 2 357 530 | | 6/2001 |
| JP | 2001/173349 | | 6/2001 |
| WO | WO 93-07358 | | 4/1993 |
| WO | WO 96-18799 | | 6/1996 |
| WO | WO 97-08418 | | 3/1997 |
| WO | WO 98-05844 | | 2/1998 |
| WO | WO 98-32948 | | 7/1998 |
| WO | WO 99-11902 | | 3/1999 |
| WO | WO 99-58810 | | 11/1999 |
| WO | WO 00-08293 | | 2/2000 |
| WO | WO 00-09853 | | 2/2000 |
| WO | WO 00-50730 | | 8/2000 |
| WO | WO 01-33033 | | 5/2001 |
| WO | WO 2004-022903 | | 3/2004 |
| WO | WO 2005/090740 | | 9/2005 |

OTHER PUBLICATIONS

"First Success with Casing-Drilling" World Oil, Feb. 1999, pp. 25.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling, " World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves To More Challenging Application," AADE Paper 01-NC-HO-32, AADE National Drilling Conference, Mar. 27-29, 2001, pp. 1-10.

Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.

Vincent, et al., "Liner and Casing Drilling—Case Histories And Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Market?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

Bickford L Dennis and Mark J. Mabile, Casing Drilling Rig Selection For Stratton Field, Texas, World Oil, vol. 226, No. 3, Mar. 2005.

G H. Kamphorst, G. L. Van Wechem, W. Boom, D. Bottger, and K. Koch, Casing Running Tool, SPE/IADC 52770.

GB Search Report from Application No. GB0722465.2 dated Jun. 1, 2008.

Canadian Office Action for Application No. 2,611,036 dated Jun. 8, 2010.

* cited by examiner

TOP DRIVE INTERLOCK

CROSS-REFERENCE TO RELATED APPLICATIONS

This application claims the benefit of U.S. Prov. Pat. App. No. 60/866,322, entitled "Top Drive Backout Interlock Method", filed on Nov. 17, 2006, which is herein incorporated by reference in its entirety.

BACKGROUND OF THE INVENTION

1. Field of the Invention

Embodiments of the present invention generally relate to methods and apparatus for improving top drive operations.

2. Description of the Related Art

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

To drill with casing, most existing top drives use a threaded crossover adapter to connect to the casing. This is because the quill of the top drives is typically not sized to connect with the threads of the casing. The crossover adapter is design to alleviate this problem. Generally, one end of the crossover adapter is designed to connect with the quill, while the other end is designed to connect with the casing. In this respect, the top drive may be adapted to retain a casing using a threaded connection.

However, the process of connecting and disconnecting a casing using a threaded connection is time consuming. For example, each time a new casing is added, the casing string must be disconnected from the crossover adapter. Thereafter, the crossover must be threaded to the new casing before the casing string may be run. Furthermore, the threading process also increases the likelihood of damage to the threads, thereby increasing the potential for downtime.

As an alternative to the threaded connection, top drives may be equipped with tubular gripping heads to facilitate the exchange of wellbore tubulars such as casing or drill pipe. Generally, tubular gripping heads have an adapter for connection to the quill of top drive and gripping members for gripping the wellbore tubular. Tubular gripping heads include an external gripping device such as a torque head or an internal gripping device such as a spear. An exemplary torque head is described in U.S. Patent Application Publication No. 2005/0257933, filed by Pietras on May 20, 2004, which is herein incorporated by reference in its entirety. An exemplary spear is described in U.S. Patent Application Publication Number US 2005/0269105, filed by Pietras on May 13, 2005, which is herein incorporated by reference in its entirety.

In most cases, the adapter of the tubular gripping head connects to the quill of the top drive using a threaded connection. The adapter may be connected to the quill either directly or indirectly, e.g., through another component such as a sacrificial saver sub. One problem that may occur with the threaded connection is inadvertent breakout of that connection during operation. For example, in a drilling with casing operation, a casing connection may be required to be backed out (i.e., unthreaded) either during the pulling of a casing string or to correct an unacceptable makeup. It may be possible that the left hand torque required to break out the casing connection exceeds the breakout torque of the connection between the adapter and the quill, thereby inadvertently disconnecting the adapter from the quill and creating a hazardous situation on the rig.

There is a need, therefore, for methods and apparatus for ensuring safe operation of a top drive.

SUMMARY OF THE INVENTION

Embodiments of the present invention generally relate to methods and apparatus for improving top drive operations. In one embodiment a method of ensuring safe operation of a top drive includes operating a top drive, thereby exerting torque on a first tubular to makeup or breakout a first threaded connection between the first tubular and a second tubular. The method further includes monitoring for break-out of a second connection between a quill of the top drive and the first tubular; and stopping operation of the top drive and/or notifying an operator of the top drive if break-out of the second connection is detected.

In another embodiment, a method of ensuring safe operation of a top drive includes operating a top drive, thereby rotating a quill of the top drive. The quill of the top drive is connected to a torque head or a spear. Hydraulic communication between the torque head or spear and a hydraulic pump is provided by a swivel. A bearing is disposed between a housing and a shaft of the swivel. The method further includes determining acceptability of operation of the bearing by monitoring a torque exerted on the swivel housing by the bearing; and stopping operation of the top drive and/or notifying an operator of the top drive if the bearing operation is unacceptable.

In another embodiment, a torque head or spear for use with a top drive includes a body having an end for forming a connection with a quill of the top drive; a gripping mechanism operably connected to the body for longitudinally and rotationally gripping a tubular; and a computer configured to perform an operation. The operation includes monitoring for break-out of the connection; and stopping operation of the top drive and/or notifying an operator of the top drive if break-out of the connection is detected.

In another embodiment, a torque head or spear for use with a top drive includes a body having an end for forming a connection with a quill of the top drive; a gripping mechanism operably connected to the body for longitudinally and rotationally gripping a tubular; and a swivel. The swivel includes a housing; a shaft disposed in the housing and connected to the body; a bearing disposed between the shaft and the housing; and a strain gage disposed on the housing and operable to indicate torque exerted on the housing by the bearing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
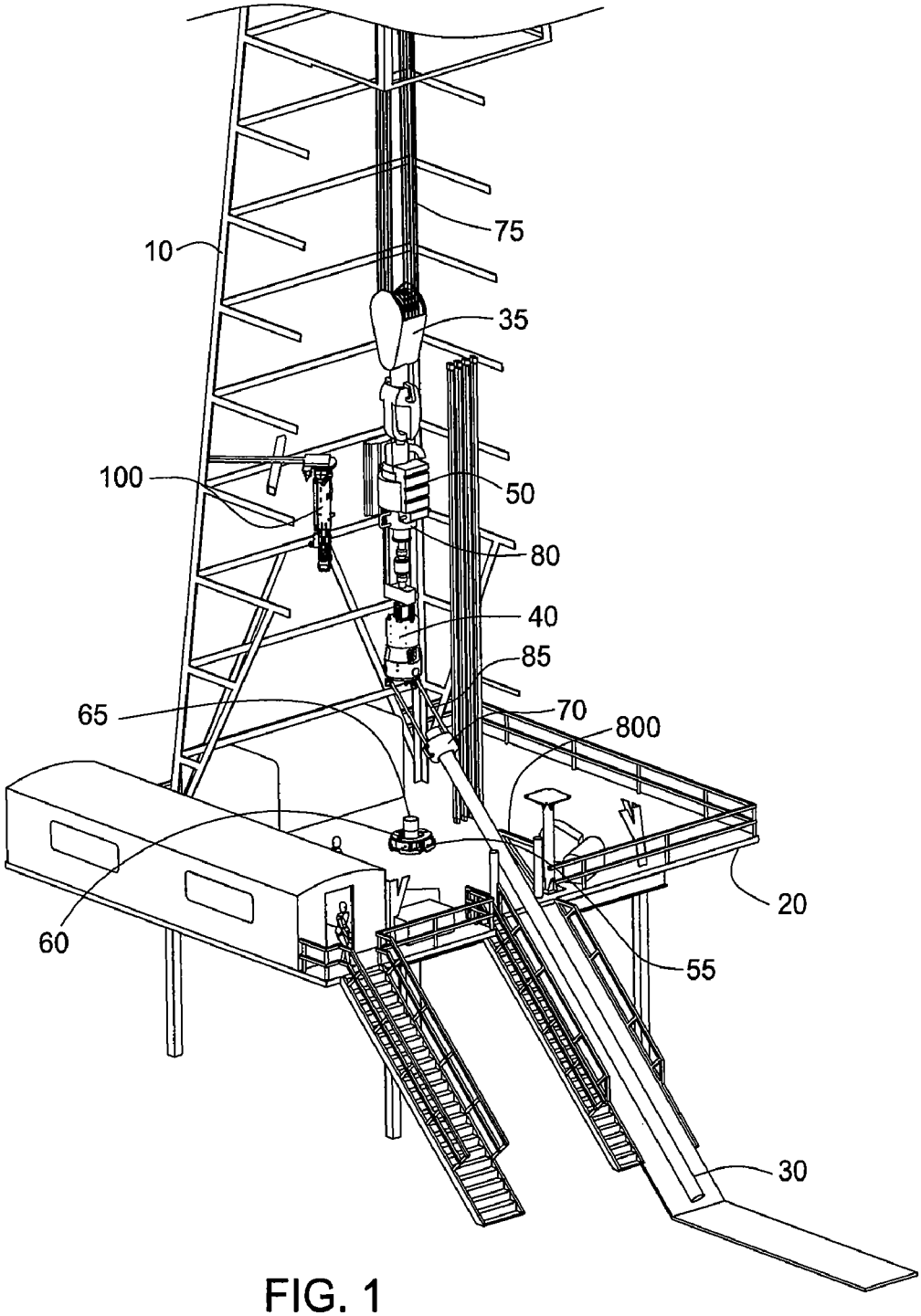
FIG. 1 is a partial view of a rig having a top drive system.

FIG. 1 shows a drilling rig 10 applicable to drilling with casing operations or a wellbore operation that involves picking up/laying down tubulars. The drilling rig 10 is located above a formation at a surface of a well. The drilling rig 10 includes a rig floor 20 and a v-door 800. The rig floor 20 has a hole 55 therethrough, the center of which is termed the well center. A spider 60 is disposed around or within the hole 55 to grippingly engage the casings 30, 65 at various stages of the drilling operation. As used herein, each casing 30, 65 may include a single casing or a casing string having more than one casing. Furthermore, aspects of the present invention are equally applicable to other types of wellbore tubulars, such as drill pipe.

The drilling rig 10 includes a traveling block 35 suspended by cables 75 above the rig floor 20. The traveling block 35 holds the top drive 50 above the rig floor 20 and may be caused to move the top drive 50 longitudinally. The top drive 50 may be supported by the travelling block 35 using a swivel which allows injection of drilling fluid into the top drive 50. The top drive 50 includes a motor 80 which is used to rotate the casing 30, 65 at various stages of the operation, such as during drilling with casing or while making up or breaking out a connection between the casings 30, 65. A railing system (partially shown) is coupled to the top drive 50 to guide the longitudinal movement of the top drive 50 and to prevent the top drive 50 from rotational movement during rotation of the casings 30, 65.

Disposed below the top drive 50 is a tubular gripping member such as a torque head 40. The torque head 40 may be utilized to grip an upper portion of the casing 30 and impart torque from the top drive to the casing 30. The torque head 40 may be coupled to an elevator 70 using one or more bails 85 to facilitate the movement of the casing 30 above the rig floor 20. In another embodiment, the bails 85 may be coupled to the top drive 50 or components attached thereto. Additionally, the rig 10 may include a pipe handling arm 100 to assist in aligning the tubulars 30, 65 for connection. In must be noted that other tubular gripping members such as a spear are contemplated for use with the top drive. An exemplary torque head suitable for use with a top drive 50 is disclosed in U.S. Patent Application Publication No. 2005/0257933, filed by Pietras on May 20, 2004, which is herein incorporated by reference in its entirety. An exemplary spear is described in U.S. Patent Application Publication Number US 2005/0269105, filed by Pietras on May 13, 2005, which is herein incorporated by reference in its entirety.

Torque Sub

Figure 2:
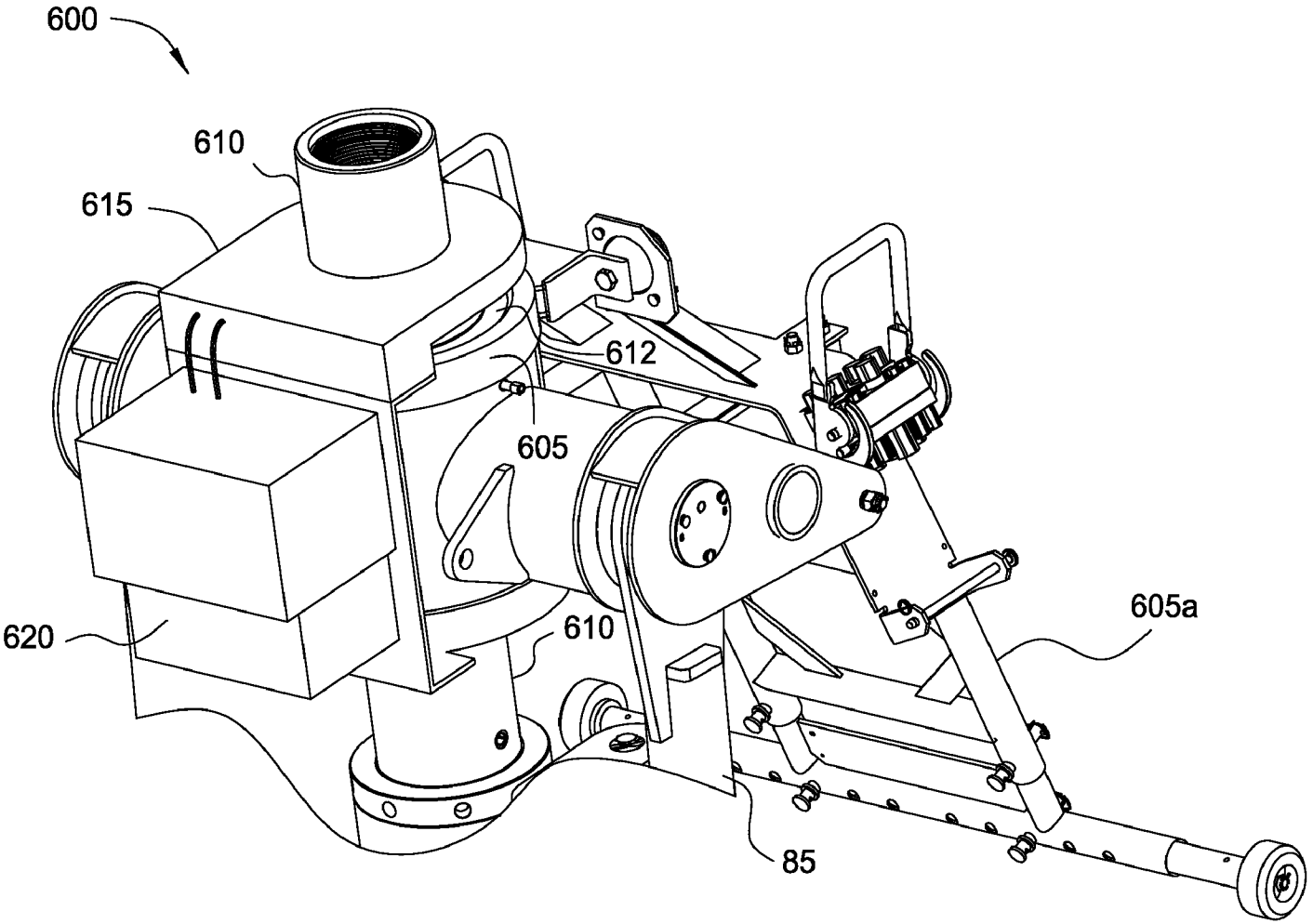
FIG. 2 is an isometric view of a torque sub usable with the top drive system.

FIG. 2 shows an exemplary torque sub/swivel 600. The torque sub 600 may be connected to the top drive 50 for measuring a torque applied by the top drive 50. The torque sub 600 may be disposed between the top drive 50 and the torque head 40. The swivel 600 may provide hydraulic communication between stationary hydraulic lines and the torque head 40 for operation thereof. The torque sub/swivel 600 may include a swivel housing 605, a swivel shaft 612, a torque shaft 610, an interface 615, and a controller 620. The swivel housing 605 is a tubular member having a bore therethrough. Longitudinally and rotationally coupled to the housing 605 is a bracket 605*a* for coupling the swivel housing 605 to the railing system, thereby preventing rotation of the swivel housing 605 during rotation of the top drive 50, but allowing for vertical movement of the swivel housing 605 with the top drive 50 under the traveling block 35. The interface 615 and the controller 620 are both mounted on the swivel housing 605. The controller 620 and the torque shaft 610 may be made from metal, such as stainless steel. The interface 615 may be made from a polymer. The bails 85 may also be pivoted to the swivel housing 605. The torque shaft 610 and the swivel shaft 612 are disposed in the bore of the swivel housing 605. The swivel shaft 612 is disposed between the torque shaft 610 and the swivel housing 605 and rotationally coupled to the torque shaft 610*a*. The swivel housing 605 is supported from the swivel shaft 612 by one or more swivel bearings (not shown) to allow rotation of the swivel shaft 612 relative to the swivel housing 605.

Figure 2D:
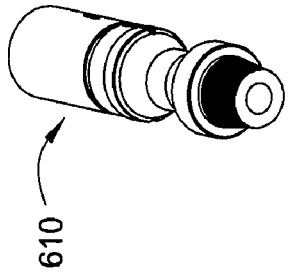
FIG. 2D is an isometric view of the torque shaft.
Figure 2C:
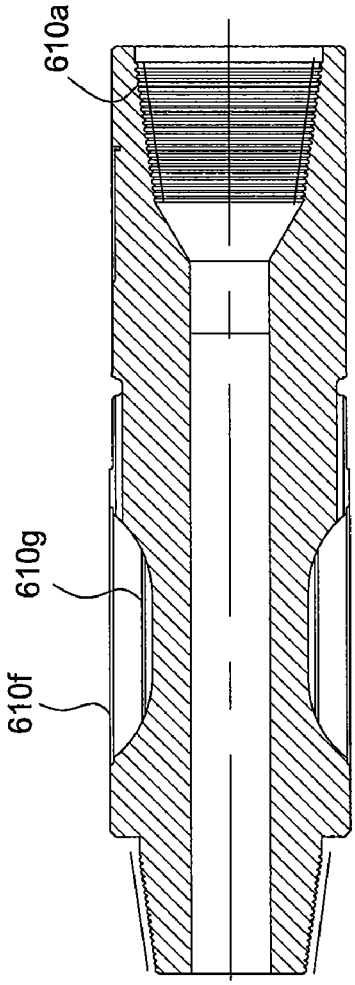
FIG. 2C is a cross section of FIG. 2A.
Figure 2A:
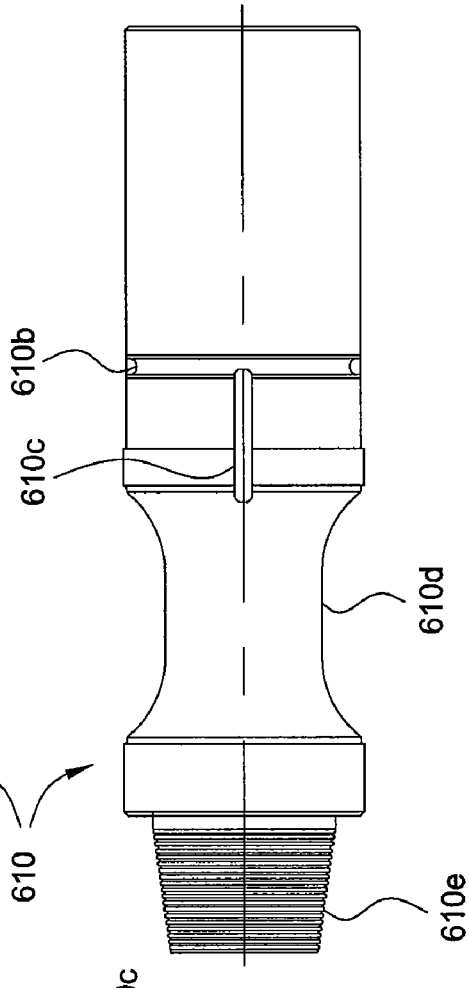
FIG. 2A is a side view of a torque shaft of the torque sub.
Figure 2B:
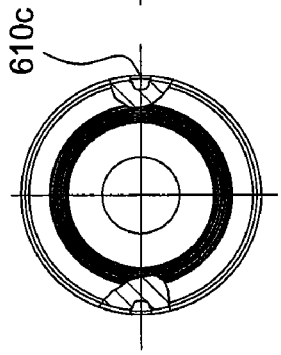
FIG. 2B is an end view of the torque shaft with a partial sectional view

FIG. 2A is a side view of the torque shaft 610 of the torque sub 600. FIG. 2B is an end view of the torque shaft 610 with a partial sectional view. FIG. 2C is a cross section of FIG. 2A. FIG. 2D is an isometric view of the torque shaft 610. The torque shaft 610 is a tubular member having a flow bore therethrough. The torque shaft 610 includes a threaded box 610*a*, a groove 610*b*, one or more longitudinal slots 610*c* (preferably two), a reduced diameter portion 610*d*, and a threaded pin 610*e*, a metal sleeve 610*f*, and a polymer (preferably rubber, more preferably silicon rubber) shield 610*g*.

The threaded box 610*a* receives the quill of the top drive 50, thereby forming a rotational connection therewith. Other equipment, such as a thread saver sub or a thread compensator (not shown), may be connected between the torque sub/swivel 600 and the quill. The pin 610*e* is received by a connector of the torque head 40, thereby forming a rotational connection therewith. A failsafe, such as set screws, may be added to the toque sub 610/torque head 40 connection. The groove 610*b* receives a secondary coil 630*b* (see FIG. 2E) which is wrapped therearound. Disposed on an outer surface of the reduced diameter portion 610*d* are one or more strain gages 680. Each strain gage 680 may be made of a thin foil grid and bonded to the tapered portion 610*d* of the shaft 610 by a polymer support, such as an epoxy glue. The foil strain gauges 680 are made from metal, such as platinum, tungsten/nickel, or chromium. Four strain gages 680 may be arranged in a Wheatstone bridge configuration. The strain gages 680 are disposed on the reduced diameter portion 610*d* at a sufficient distance from either taper so that stress/strain transition effects at the tapers are fully dissipated. The slots 610*c* provide a path for wiring between the secondary coil 630*b* and the strain gages 680 and also house an antenna 645*a* (see FIG. 2E).

The shield 610*g* is disposed proximate to the outer surface of the reduced diameter portion 610*d*. The shield 610*g* may be applied as a coating or thick film over strain gages 680. Disposed between the shield 610*g* and the sleeve 610*f* are electronic components 635,640 (see FIG. 2E). The electronic components 635,640 are encased in a polymer mold 630 (see FIG. 2E). The shield 610*g* absorbs any forces that the mold 630 may otherwise exert on the strain gages 680 due to the hardening of the mold. The shield 610*g* also protects the delicate strain gages 680 from any chemicals present at the wellsite that may otherwise be inadvertently splattered on the strain gages 680. The sleeve 610*f* is disposed along the reduced diameter portion 610*d*. A recess is formed in each of the tapers to seat the shield 610*f*. The sleeve 610*f* forms a substantially continuous outside diameter of the torque shaft 610 through the reduced diameter portion 610*d*. Preferably, the sleeve 610*f* is made from sheet metal and welded to the shaft 610. The sleeve 610*f* also has an injection port formed therethrough (not shown) for filling fluid mold material to encase the electronic components 635,640.

Figure 2E:
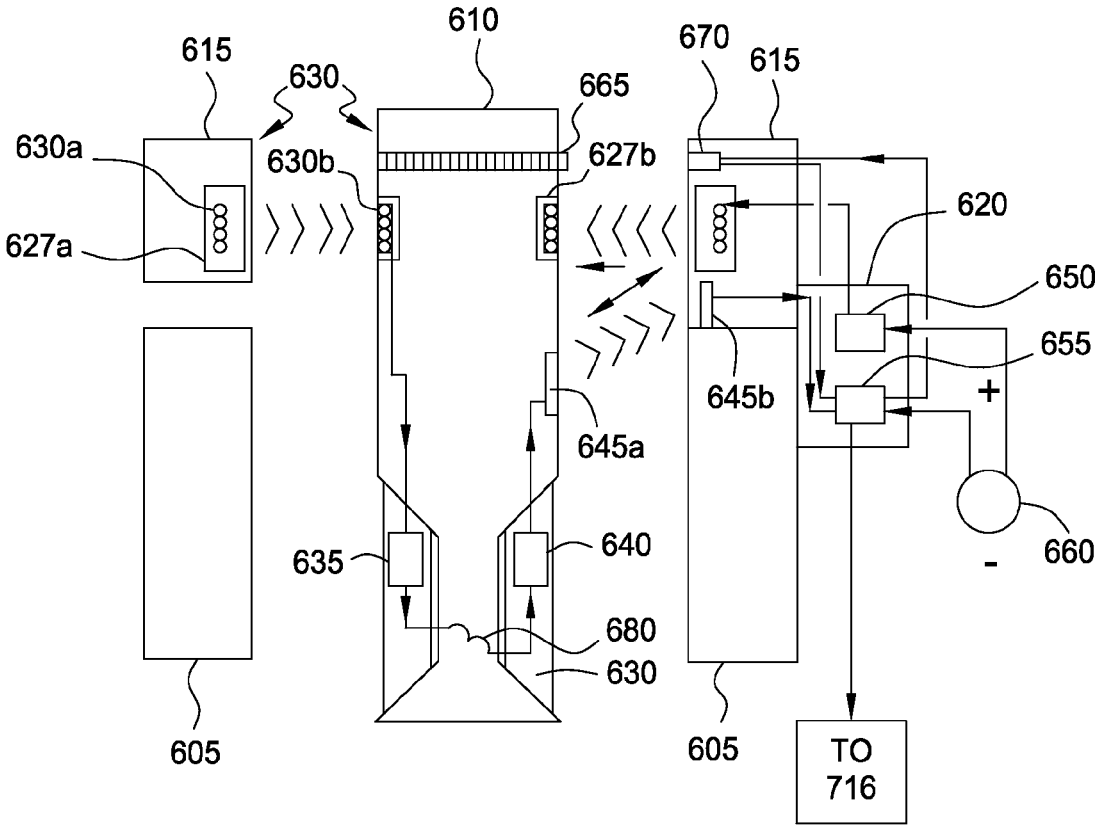
FIG. 2E is an electrical diagram showing data and electrical communication between the torque shaft and a housing of the torque sub.

FIG. 2E is an electrical diagram showing data and electrical communication between the torque shaft 610 and the enclosure 605. A power source 660 may be provided in the form of a battery pack in the controller 620, an-onsite generator, utility lines, or other suitable power source. The power source 660 is electrically coupled to a sine wave generator 650. Preferably, the sine wave generator 650 will output a sine wave signal having a frequency less than nine kHz to avoid electromagnetic interference. The sine wave generator 650 is in electrical communication with a primary coil 630*a* of an electrical power coupling 630.

The electrical power coupling 630 is an inductive energy transfer device. Even though the coupling 630 transfers energy between the stationary interface 615 and the rotatable torque shaft 610, the coupling 630 is devoid of any mechanical contact between the interface 615 and the torque shaft 610. In general, the coupling 630 acts similar to a common transformer in that it employs electromagnetic induction to transfer electrical energy from one circuit, via its primary coil 630*a*, to another, via its secondary coil 630*b*, and does so without direct connection between circuits. The coupling 630 includes the secondary coil 630*b* mounted on the rotatable torque shaft 610. The primary 630*a* and secondary 630*b* coils are structurally decoupled from each other.

The primary coil 630*a* may be encased in a polymer 627*a*, such as epoxy. The secondary coil 630*b* may be wrapped around a coil housing 627*b* disposed in the groove 610*b*. The coil housing 627*b* is made from a polymer and may be assembled from two halves to facilitate insertion around the groove 610*b*. Optionally, the secondary coil 630*b* is then molded in the coil housing 627*b* with a polymer. The primary 630*a* and secondary coils 630*b* are made from an electrically conductive material, such as copper, copper alloy, aluminum, or aluminum alloy. The primary 630*a* and/or secondary 630*b* coils may be jacketed with an insulating polymer. In operation, the alternating current (AC) signal generated by sine wave generator 650 is applied to the primary coil 630*a*. When the AC flows through the primary coil 630*a*, the resulting magnetic flux induces an AC signal across the secondary coil 630*b*. The induced voltage causes a current to flow to rectifier and direct current (DC) voltage regulator (DCRR) 635. A constant power is transmitted to the DCRR 635, even when torque shaft 610 is rotated by the top drive 100. The primary coil 630*a* and the secondary coil 630*b* have their parameters (i.e., number of wrapped wires) selected so that an appropriate voltage may be generated by the sine wave generator 650 and applied to the primary coil 630*a* to develop an output signal across the secondary coil 630*b*.

The DCRR 635 converts the induced AC signal from the secondary coil 630*b* into a suitable DC signal for use by the other electrical components of the torque shaft 610. In one embodiment, the DCRR outputs a first signal to the strain gages 680 and a second signal to an amplifier and microprocessor controller (AMC) 640. The first signal is split into sub-signals which flow across the strain gages 680, are then amplified by the amplifier 640, and are fed to the controller 640. The controller 640 converts the analog signals from the strain gages 680 into digital signals, multiplexes them into a data stream, and outputs the data stream to a modem associated with controller 640 (preferably a radio frequency modem). The modem modulates the data stream for transmission from antenna 645*a*. The antenna 645*a* transmits the encoded data stream to an antenna 645*b* disposed in the interface 615. The antenna 645*b* sends the received data stream to a modem, which demodulates the data signal and outputs it to a joint analyzer controller 655. Alternatively, the analog signals from the strain gages may be multiplexed and modulated without conversion to digital format. Alternatively, conventional slip rings, an electric swivel coupling, roll rings, or transmitters using fluid metal may be used to transfer data from the shaft 610 to the interface 615.

The torque shaft may further include a turns counter 665, 670. The turns counter may include a turns gear 665 and a proximity sensor 670. The turns gear 665 is rotationally coupled to the torque shaft 610. The proximity sensor 670 is disposed in the interface 615 for sensing movement of the gear 665. The sensitivity of the gear/sensor 665,670 arrangement may be, for example, one-tenth of a turn; one-hundredth of a turn; or one-thousandth of a turn. However, other sensitivities are contemplated. The sensor 670 is adapted to send an output signal to the joint analyzer controller 655. It is contemplated that a friction wheel/encoder device (see FIG. 4), a gear and pinion arrangement, or other suitable gear/sensor arrangements known to person of ordinary skill in the art may be used to measure turns of the torque shaft.

The controller 655 is adapted to process the data from the strain gages 680 and the proximity sensor 670 to calculate respective torque, longitudinal load, and turns values therefrom. For example, the controller 655 may de-code the data stream from the strain gages 680, combine that data stream with the turns data, and re-format the data into a usable input (i.e., analog, field bus, or Ethernet) for a make-up computer system 706 (see FIG. 3). Using the calculated values, the controller may control operation of the top drive 50 and/or the torque head 40. The controller 655 may be powered by the power source 660. The controller 655 may also be connected to a wide area network (WAN) (preferably, the Internet) so that office engineers/technicians may remotely communicate with the controller 655. Further, a personal digital assistant (PDA) may be connected to the WAN so that engineers/technicians may communicate with the controller 655 from any worldwide location.

The torque sub 600 is also disclosed in U.S. Patent App. Pub. No. 2007/0251701 filed by Jahn, et al. on Apr. 27, 2007, which application is herein incorporated by reference in its entirety.

Tubular Makeup System

Figure 3:
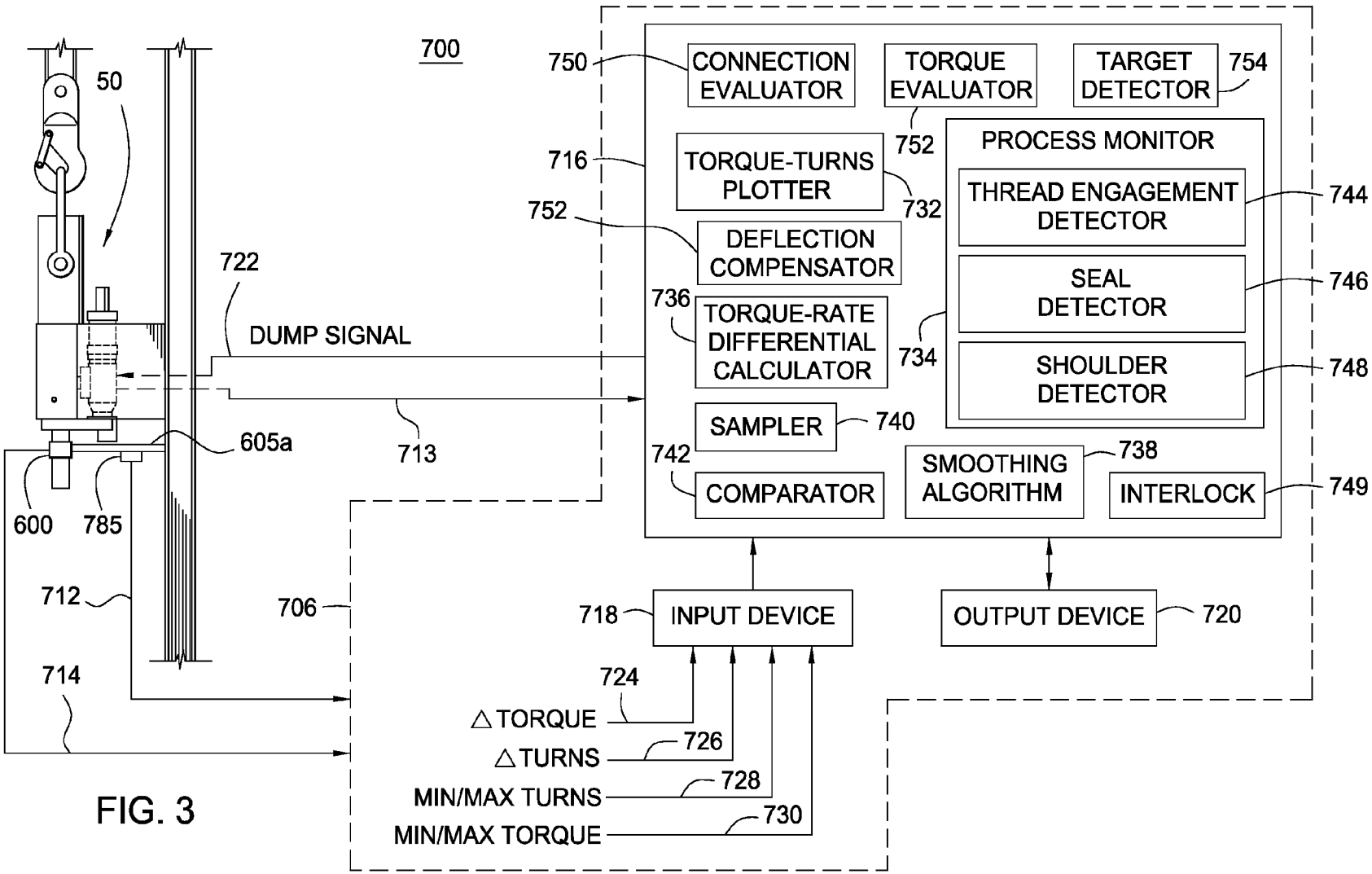
FIG. 3 is a block diagram illustrating a tubular make-up system, according to one embodiment of the present invention.

FIG. 3 is a block diagram illustrating a tubular make-up system 700, according to one embodiment of the present invention. The tubular make-up system 700 may include the top drive 50, torque head 40, a computer system 706 and torque sub 600, torque meter 900, or upper turns counter 905*a* (without lower turns counter 905*b*). Whether the tubular make-up system 700 includes the torque sub 600, torque meter 900, or the torque head turns counter may depend on factors, such as rig space and cost. During make-up of a tubing assembly 30, 65, a computer 716 of the computer system 706 monitors the turns count signals and torque signals 714 from the torque sub 600 and compares the measured values of these signals with predetermined values. If the torque sub 600 or torque meter 900 is not used, the computer 716 may calculate torque and rotation output of the top drive 50 by measuring voltage, current, and/or frequency (if AC top drive) of the power 713 input to the top drive. For example, in a DC top drive, the speed is proportional to the voltage input and the torque is proportional to the current input. Due to internal losses of the top drive, the calculation is less accurate than measurements from the torque sub 600; however, the computer 716 may compensate the calculation using predetermined performance data of the top drive 50 or generalized top drive data or the uncompensated calculation may suffice. An analogous calculation may also be made for a hydraulic top drive (i.e., pressure and flow rate).

Predetermined values may be input to the computer 716 via one or more input devices 718, such as a keypad. Illustrative predetermined values which may be input, by an operator or otherwise, include a delta torque value 724, a delta turns value 726, minimum and maximum turns values 728 and minimum and maximum torque values 730. During makeup of a tubing assembly, various output may be observed by an operator on output device, such as a display screen, which may be one of a plurality of output devices 720. The format and content of the displayed output may vary in different embodiments. By way of example, an operator may observe the various predefined values which have been input for a particular tubing connection. Further, the operator may observe graphical information such as a representation of the torque rate curve 500 and the torque rate differential curve 500*a*. The plurality of output devices 720 may also include a printer such as a strip chart recorder or a digital printer, or a plotter, such as an x-y plotter, to provide a hard copy output. The plurality of output devices 720 may further include a horn or other audio equipment to alert the operator of significant events occurring during make-up, such as the shoulder condition, the terminal connection position and/or a bad connection.

Upon the occurrence of a predefined event(s), the computer system 706 may output a dump signal 722 to automatically shut down the top drive unit 100. For example, dump signal 722 may be issued upon the terminal connection position and/or a bad connection. The comparison of measured turn count values and torque values with respect to predetermined values is performed by one or more functional units of the computer 716. The functional units may generally be implemented as hardware, software or a combination thereof. By way of illustration of a particular embodiment, the functional units are software. In one embodiment, the functional units include a torque-turns plotter algorithm 732, a process monitor 734, a torque rate differential calculator 736, a smoothing algorithm 738, a sampler 740, a comparator 742, a deflection compensator 752, and an interlock 749. It should be understood, however, that although described separately, the functions of one or more functional units may in fact be performed by a single unit, and that separate units are shown and described herein for purposes of clarity and illustration. As such, the functional units 732-742, 749, and 752 may be considered logical representations, rather than well-defined and individually distinguishable components of software or hardware.

The frequency with which torque and rotation are measured may be specified by the sampler 740. The sampler 740 may be configurable, so that an operator may input a desired sampling frequency. The measured torque and rotation values may be stored as a paired set in a buffer area of computer memory. Further, the rate of change of torque with rotation (i.e., a derivative) may be calculated for each paired set of measurements by the torque rate differential calculator 736. At least two measurements are needed before a rate of change calculation can be made. In one embodiment, the smoothing algorithm 738 operates to smooth the derivative curve (e.g., by way of a running average). These three values (torque, rotation, and rate of change of torque) may then be plotted by the plotter 732 for display on the output device 720.

In one embodiment, the rotation value may be corrected to account for system deflections using the deflection compensator 752. As discussed above, torque is applied to a tubular 30 (e.g., casing) using a top drive 50. The top drive 50 may experience deflection which is inherently added to the rotation value provided by the turns gear 665 or other turn counting device. Further, a top drive unit 50 will generally apply the torque from the end of the tubular that is distal from the end that is being made. Because the length of the tubular may range from about 20 ft. to about 90 ft., deflection of the tubular may occur and will also be inherently added to the rotation value provided by the turns gear 665. For the sake of simplicity, these two deflections will collectively be referred to as system deflection. In some instances, the system deflection may cause an incorrect reading of the tubular makeup process, which could result in a damaged connection.

To compensate for the system deflection, the deflection compensator 752 utilizes a measured torque value to reference a predefined value (or formula) to find (or calculate) the system deflection for the measured torque value. The deflection compensator 652 includes a database of predefined values or a formula derived therefrom for various torque and system deflections. These values (or formula) may be calculated theoretically or measured empirically. Empirical measurement may be accomplished by substituting a rigid member, e.g., a blank tubular, for the tubular and causing the top drive unit 50 to exert a range of torque corresponding to a range that would be exerted on the tubular to properly make-up a connection. The torque and rotation values measured would then be monitored and recorded in a database. The deflection of the tubular may also be added into the system deflection.

Alternatively, instead of using a blank for testing the top drive, the end of the tubular distal from the top drive unit 50 may simply be locked into a spider. The top drive unit 50 may then be operated across the desired torque range while the resulting torque and rotation values are measured and recorded. The measured rotation value is the rotational deflection of both the top drive unit 50 and the tubular. Alternatively, the deflection compensator 752 may only include a formula or database of torques and deflections for the tubular. The theoretical formula for deflection of the tubular may be pre-programmed into the deflection compensator 752 for a separate calculation of the deflection of the tubular. Theoretical formulas for this deflection may be readily available to a person of ordinary skill in the art. The calculated torsional deflection may then be added to the top drive deflection to calculate the system deflection.

After the system deflection value is determined from the measured torque value, the deflection compensator 752 then subtracts the system deflection value from the measured rotation value to calculate a corrected rotation value. The three measured values—torque, rotation, and rate of change of torque—are then compared by the comparator 742, either continuously or at selected rotational positions, with predetermined values. For example, the predetermined values may be minimum and maximum torque values and minimum and maximum turn values.

Based on the comparison of measured/calculated/corrected values with predefined values, the process monitor 734 determines the occurrence of various events and whether to continue rotation or abort the makeup. In one embodiment, the process monitor 734 includes a thread engagement detection algorithm 744, a seal detection algorithm 746 and a shoulder detection algorithm 748. The thread engagement detection algorithm 744 monitors for thread engagement of the two threaded members. Upon detection of thread engagement a first marker is stored. The marker may be quantified, for example, by time, rotation, torque, a derivative of torque or time, or a combination of any such quantifications. During continued rotation, the seal detection algorithm 746 monitors for the seal condition. This may be accomplished by comparing the calculated derivative (rate of change of torque) with a predetermined threshold seal condition value. A second marker indicating the seal condition is stored when the seal condition is detected.

At this point, the turns value and torque value at the seal condition may be evaluated by the connection evaluator 750. For example, a determination may be made as to whether the corrected turns value and/or torque value are within specified limits. The specified limits may be predetermined, or based off of a value measured during makeup. If the connection evaluator 750 determines a bad connection, rotation may be terminated. Otherwise rotation continues and the shoulder detection algorithm 748 monitors for shoulder condition. This may be accomplished by comparing the calculated derivative (rate of change of torque) with a predetermined threshold shoulder condition value. When the shoulder condition is detected, a third marker indicating the shoulder condition is stored. The connection evaluator 750 may then determine whether the turns value and torque value at the shoulder condition are acceptable.

In one embodiment, the connection evaluator 750 determines whether the change in torque and rotation between these second and third markers are within a predetermined acceptable range. If the values, or the change in values, are not acceptable, the connection evaluator 750 indicates a bad connection. If, however, the values/change are/is acceptable, the target calculator 752 calculates a target torque value and/or target turns value. The target value is calculated by adding a predetermined delta value (torque or turns) to a measured reference value(s). The measured reference value may be the measured torque value or turns value corresponding to the detected shoulder condition. In one embodiment, a target torque value and a target turns value are calculated based off of the measured torque value and turns value, respectively, corresponding to the detected shoulder condition.

Upon continuing rotation, the target detector 754 monitors for the calculated target value(s). Once the target value is reached, rotation is terminated. In the event both a target torque value and a target turns value are used for a given makeup, rotation may continue upon reaching the first target or until reaching the second target, so long as both values (torque and turns) stay within an acceptable range. Alternatively, the deflection compensator 752 may not be activated until after the shoulder condition has been detected.

Whether a target value is based on torque, turns or a combination, the target values are not predefined, i.e., known in advance of determining that the shoulder condition has been reached. In contrast, the delta torque and delta turns values, which are added to the corresponding torque/turn value as measured when the shoulder condition is reached, are predetermined. In one embodiment, these predetermined values are empirically derived based on the geometry and characteristics of material (e.g., strength) of two threaded members being threaded together. Exemplary embodiments of the tubular makeup system are disclosed in U.S. Provisional Patent Application Ser. No. 60/763,306, filed on Jan. 30, 2006, which application is herein incorporated by reference in its entirety.

Torque Meter

Figure 4:
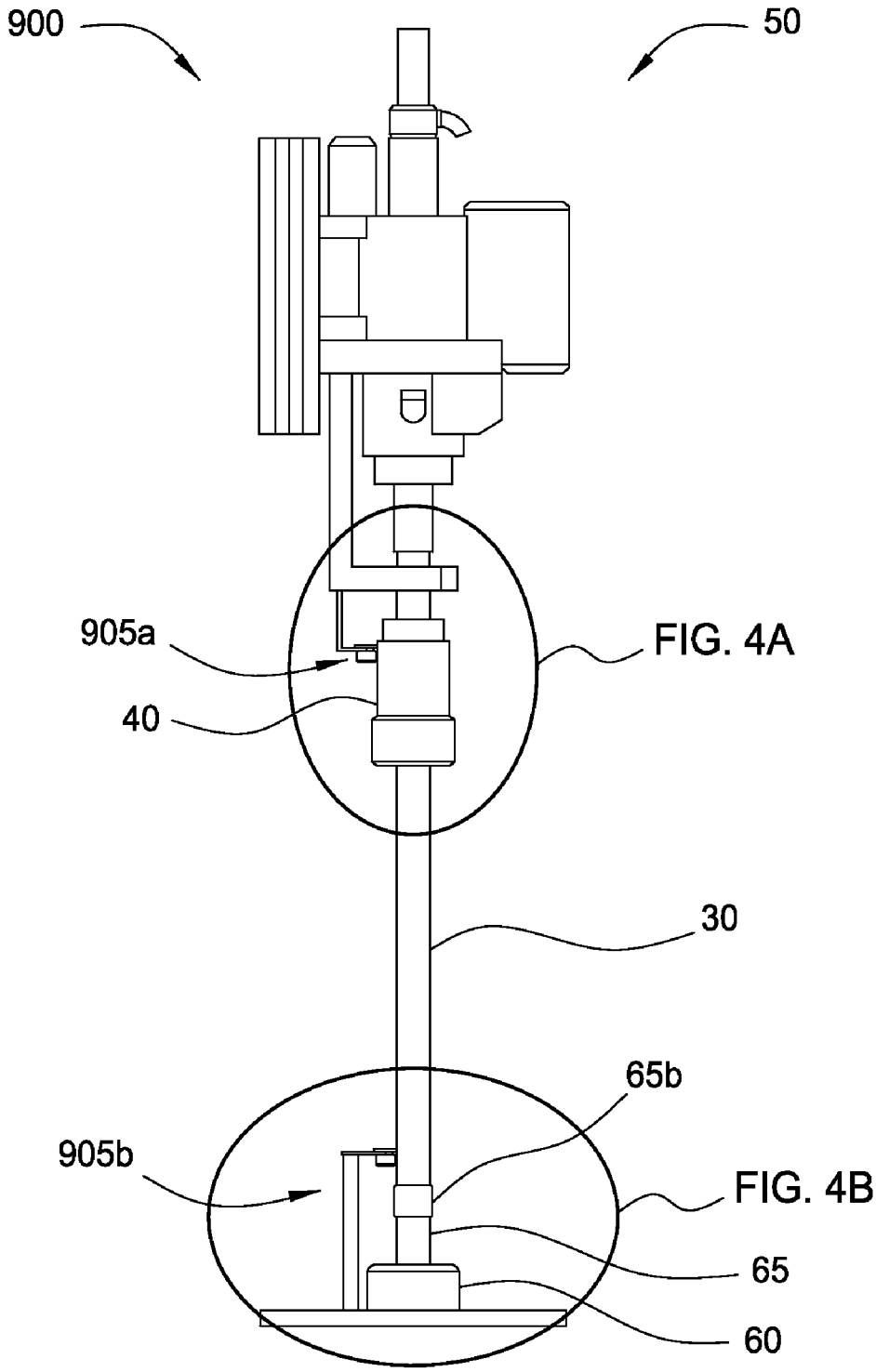
FIG. 4 is a side view of a top drive system employing a torque meter.
Figure 4A:
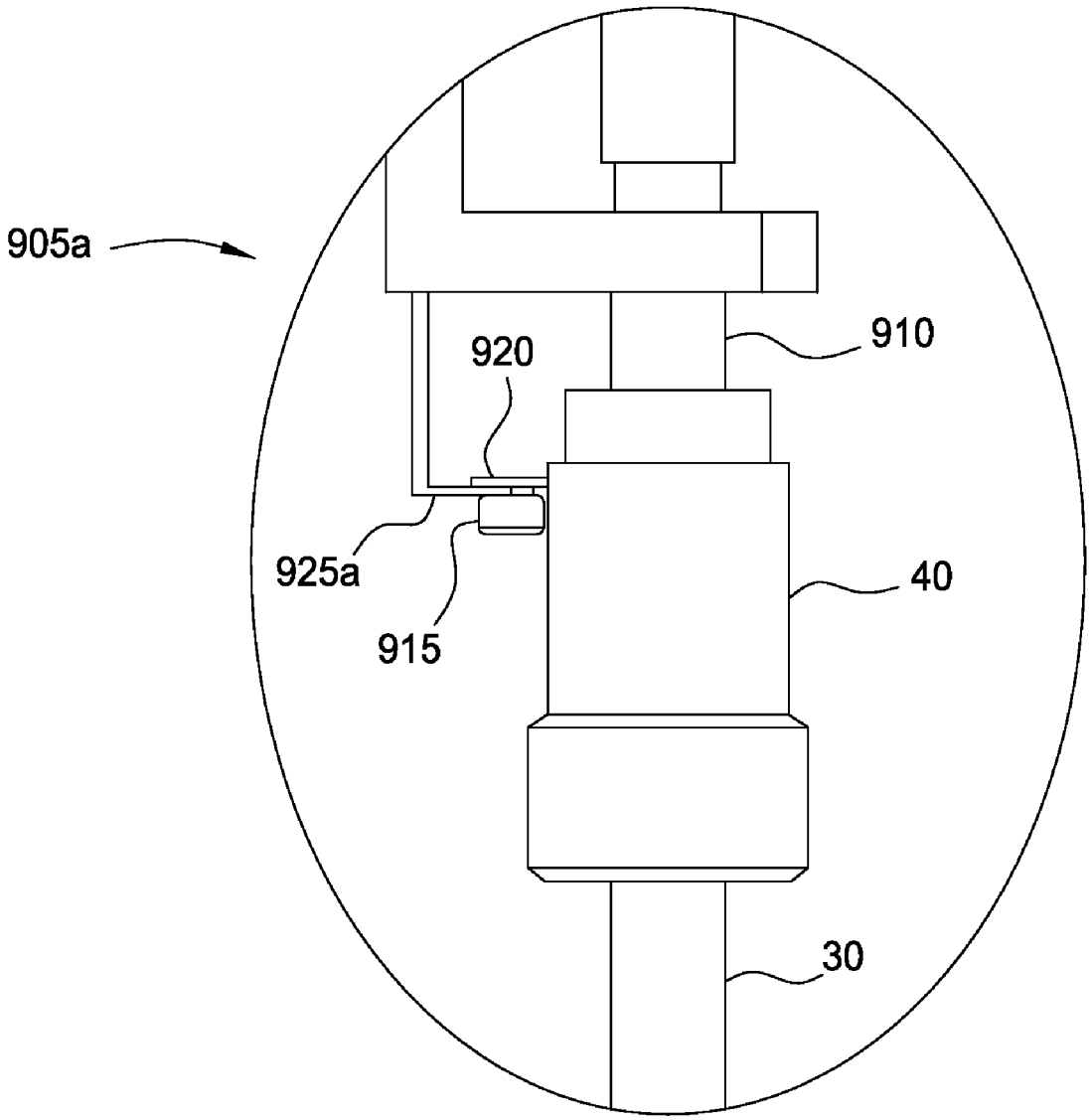
FIG. 4A is an enlargement of a portion of FIG. 4.
Figure 4B:
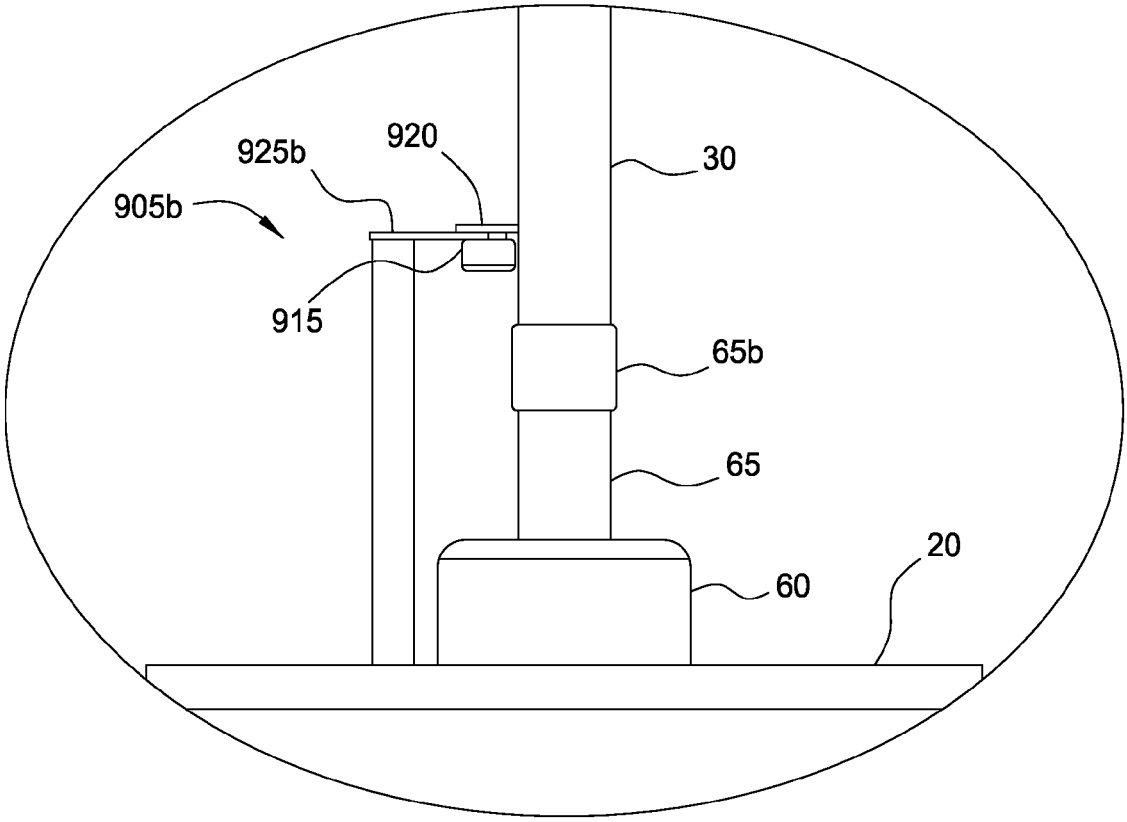
FIG. 4B is an enlargement of another portion of FIG. 4.

FIG. 4 is a side view of a top drive system employing the torque meter 900. FIG. 4A is an enlargement of a portion of FIG. 4. FIG. 4B is an enlargement of another portion of FIG. 4. The torque meter 900 includes upper 905*a* and lower 905*b* turns counters. The upper turns counter 905*a* is located on the torque head 40. Alternatively, if a crossover or direct connection between the tubular and the quill 910 is used instead of the torque head, then the upper turns counter 905*a* may be located below the connection therebetween. Alternatively, the upper turns counter 905*a* may be located near an upper longitudinal end of the first tubular 30. The lower turns counter 915*b* is located along the first tubular 30 proximate to the box 65*b*. Each turns counter includes a friction wheel 920, an encoder 915, and a bracket 925*a,b*. The friction wheel 920 of the upper turns counter 905*a* is held into contact with the torque head 40. The friction wheel 920 of the lower turns counter 905*b* is held into contact with the first tubular 30. Each friction wheel is coated with a material, such as a polymer, exhibiting a high coefficient of friction with metal. The frictional contact couples each friction wheel with the rotational movement of outer surfaces of the drive shaft 910 and first tubular 30, respectively. Each encoder 915 measures the rotation of the respective friction wheel 920 and translates the rotation to an analog signal indicative thereof. Alternatively, a gear and proximity sensor arrangement or a gear and pinion arrangement may be used instead of a friction wheel for the upper 905*a* and/or lower 905*b* turns counters. In this alternate, for the lower turns counter 905*b*, the gear would be split to facilitate mounting on the first tubular 402.

These rotational values may be transmitted to the joint make-up system 700 for analysis. Due to the arrangement of the upper 905*a* and lower 905*b* turns counters, a torsional deflection of the first tubular 402 may be measured. This is found by subtracting the turns measured by the lower turns counter 905*b* from the turns measured by the upper turns counter 905*a*. By turns measurement, it is meant that the rotational value from each turns counter 905*a,b* has been converted to a rotational value of the first tubular 402. Once the torsional deflection is known a controller or computer 706 may calculate the torque exerted on the first tubular by the top drive 100 from geometry and material properties of the first tubular. If a length of the tubular 402 varies, the length may be measured and input manually (i.e. using a rope scale) or electronically using a position signal from the draw works 105. The turns signal used for monitoring the make-up process would be that from the bottom turns counter 905*b*, since the measurement would not be skewed by torsional deflection of the first tubular 402.

Interlock Operation

Figure 5:
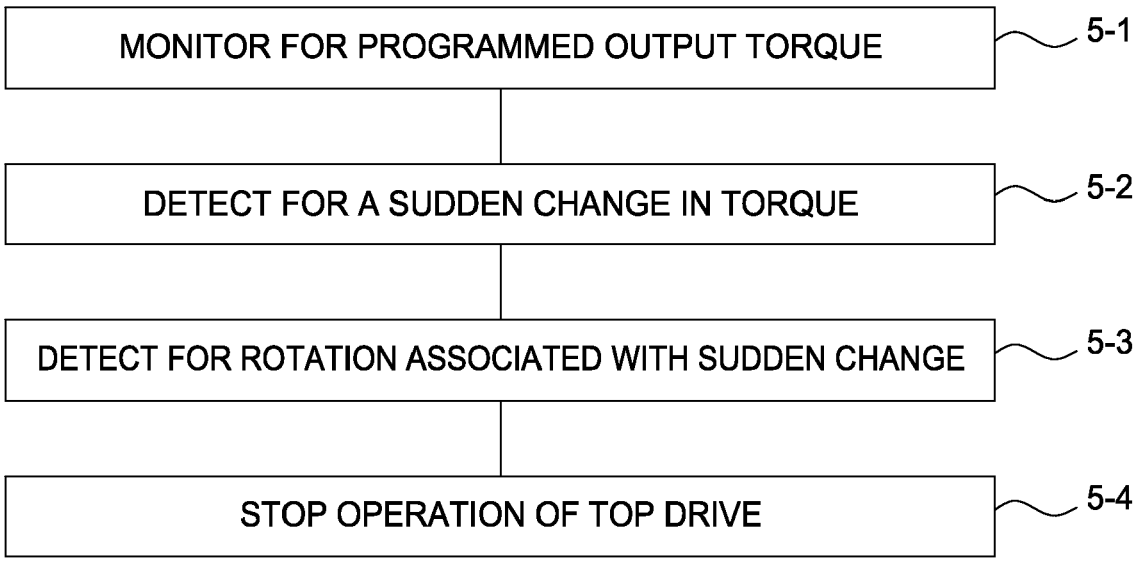
FIG. 5 is a flow chart illustrating operation of an interlock of the make-up system of FIG. 3, according to another embodiment of the present invention.

FIG. 5 is a flow chart illustrating operation of the interlock 749, according to another embodiment of the present invention. As discussed above, there is a threaded connection between the torque head 40/torque sub 600 (if present) and the quill and may also be one or more intermediate connections (hereinafter top drive connections). The interlock 749 may detect a breakout at one of these connections. Typically, the connections are right-hand connections as are most tubulars that the top drive is used to make up. However, to breakout connections, left-hand torque is applied to the tubular 30 which also tends to break-out the top drive connections. Additionally, the interlock 749 may be used to detect break-out of the top drive connections during make-up of left-hand connections, such as expandable tubulars, or any time the top-drive 50 exerts an opposite-hand torque to that of the top-drive connections. Use of the interlock 749 is not limited to top drives equipped with torque heads or spears but may also be used with crossovers or direct connection between the top drive and the tubular.

At step 5-1, the interlock 749 monitors the output torque of the top drive 50 and compares the output torque to a predetermined or programmed output torque. As discussed above, this act may be performed using the torque sub 600, torque meter 900, or calculated from input power 713. A left-hand direction of the output torque may be indicated by a negative torque value. Examples of the predetermined torque are any left-hand torque and a maximum (minimum if positive convention) breakout torque of the top drive connections. If the monitored torque is less than (assuming negative convention for left hand torque) the predetermined torque, the interlock proceeds to step 5-2 of the control logic.

At step 5-2, the interlock detects any sudden change (i.e., increase for negative convention or decrease for positive convention or absolute value) in the torque value during operation. A sudden increase in torque at the torque head 40 indicates a breakout of either one of the top drive connections or the connection between the tubulars 30, 65. The interlock may calculate a derivate of the torque with respect to time or with respect to turns to aid in detecting the sudden increase. A sudden increase in torque may be detected by monitoring the derivative for a change in sign. For example, assuming a negative convention during a breakout operation, the derivative may be a substantially constant negative value until one of the connections breaks. At or near breakout, the derivative will exhibit an abrupt transition to a positive value. Once the breakout is determined, the interlock proceeds to step 5-3.

At step 5-3, the interlock 749 detects for rotation associated with the sudden change in torque so that the interlock may determine if the breakout is at the connection between the tubulars 30, 65 or if the breakout is at one of the top drive connections. If the torque sub 600 is being used, the reading from the sensor 670 will allow the interlock to ascertain where the breakout is. If the breakout is between the torque sub 600 and the top drive 50, then the quill will rotate while the torque sub remains stationary. If the breakout is at the connection between the tubulars 30, 65, then the torque sub 600 will rotate with the quill and the first tubular 30. If the either the torque meter 900 or the power input is used to calculate the output torque, then the interlock 749 may use the upper turns counter 905*a* to ascertain where the breakout is. Alternatively or additionally, if the torque meter 900 is used, then the interlock 749 may use the lower turns counter 905*b* to determine if the first tubular 30 is rotating. The interlock 749 may calculate a differential of rotation values or a rotational velocity of the torque sub 600/torque head 40 and compare the differential rotation/rotational velocity to a predetermined number (i.e., zero or near zero) to determine if the torque sub 600/torque head 40 is rotating.

If the interlock 749 determines that the breakout is at one of the top drive connections (i.e., the torque head 40 or the torque sub 600 is not rotating), then the interlock proceeds to step 5-4. At step 5-4, the interlock 749 may then sound an audible alarm and/or display a visual signal to the operator to stop rotation of the top drive 50 to prevent back out of the top drive connections. Additionally or alternatively, the interlock 749 may automatically stop the top drive 50. If the interlock 749 determines that the breakout is at the tubular connection 30, 65, then the interlock allows the breakout operation to proceed. The interlock may utilize fuzzy logic in performing the control logic of FIG. 5.

In an alternative embodiment (not shown), monitoring output torque of the top drive is not required. This alternative may be performed using the torque sub 600, torque meter 900, or upper turns counter 905*a* configurations. This alternative may also be used in addition to the logic of FIG. 5. In this alternative, the interlock may monitor readings/calculations from and calculate a differential between the calculated rotation of the top drive and the sensor 670 or the upper turns counter 905*a*. Alternatively, the interlock 749 may calculate rotational velocities of the quill and the torque sub 600/torque head 40 and calculate a differential between the rotational velocities. If the differential is less than (again using a negative convention) a predetermined number, then the interlock 749 may sound/display an alarm and/or halt operation of the top drive. The predetermined number may be set to account for deflection and/or inaccuracy from the calculated rotation value.

In a second alternative embodiment applicable to make-up systems 700 using the torque sub 600 or the torque meter 900, the interlock 749 may calculate a differential between the torque value measured from the torque sub 600 or the calculated torque value from the torque meter 900 and the calculated output torque of the top drive 50. The interlock 749 may also calculate a turns differential as discussed in the first alternative. The interlock 749 may then compare the two delta values to respective predetermined values and sound an alarm and/or halt operation of the top drive 50 if the two delta values are less than the predetermined values.

In a third alternative embodiment, a strain gage 785 may be bonded to the swivel housing 605 (including the swivel bracket 605*a*) so that the interlock 749 may monitor performance of the swivel bearings. The bearing performance may be monitored during any operation of the top drive, i.e., making up/breaking out connections or drilling (with drill pipe or casing). Discussion of torque relative to the swivel bearings is done assuming right-hand (positive) torque is being applied as is typical for operation of a top drive 50. This alternative may be performed in addition to any of the breakout monitoring, discussed above. If the swivel bearings should fail, excessive torque may be transferred from the top drive 50 to the bracket 605*a*, thereby causing substantial damage to the bracket 605*a* and possibly the swivel 600 as well as creating a hazard on the rig. The strain gage 785 is positioned on the bracket 605*a* to provide a signal 712 to the computer 716 indicative of the torque exerted on the swivel housing 605 by the top drive 50 through the swivel bearings. The interlock 749 may receive the signal 712 and calculate the torque exerted on the swivel housing 605 from predetermined structural properties of the swivel housing. The interlock 749 may calculate a differential between the output torque of the top drive 50 (calculated or measured) and the swivel torque.

If the bearings are functioning properly, this differential should be relatively large as friction in the bearings (and seals) should only transmit a fraction of the top drive torque. If the swivel bearings should start to fail, this differential will begin to decrease. The interlock 749 may detect failure of the swivel bearings by comparing the differential to a predetermined value. Alternatively, the interlock 749 may calculate a derivative of the differential with respect to time or turns and compare the derivative to a predetermined value. Alternatively, the interlock 749 may divide the swivel torque by the top drive torque to create a ratio (or percentage) and compare the ratio to a predetermined ratio. Failure of the bearing would be indicated by ratio greater than the predetermined ratio. The interlock 749 may only monitor swivel performance above a predetermined output torque of the top drive 50 to eliminate false alarms. In any event, if the interlock 749 detects failure of the swivel bearings, then the interlock 749 may sound/display an alarm and/or halt operation of the top drive 50. Alternatively, the interlock 749 may compare the calculated torque value to a predetermined value (without regard to the top drive torque) to determine failure of the swivel bearings.

While the foregoing is directed to embodiments of the present invention, other and further embodiments of the invention may be devised without departing from the basic scope thereof, and the scope thereof is determined by the claims that follow.

What is claimed is:

1. A method of ensuring safe operation of a top drive, comprising:

operating a top drive, thereby exerting torque on a first tubular to makeup or break-out a first threaded connection between the first tubular and a second tubular;

during operation of the top drive, monitoring for break-out of a second threaded connection between a quill of the top drive and the first tubular; and stopping operation of the top drive and/or notifying an operator of the top drive if break-out of the second connection is detected.

2. The method of claim 1, wherein the second connection is monitored by monitoring the torque and determining if the torque is in a loosening direction of the second connection.

3. The method of claim 2, wherein the second connection is further monitored by monitoring for a sudden change in the torque if the torque is in the loosening direction of the second connection.

4. The method of claim 3, wherein the second connection is further monitored by measuring rotation of the first tubular if the sudden change in torque is detected.

5. The method of claim 3, wherein:

the second connection is between the quill and a torque head or spear gripping the first tubular, and the second connection is further monitored by measuring rotation of the torque head or spear if the sudden change in torque is detected.

6. The method of claim 3, wherein:

the second connection is between the quill and a torque shaft having a strain gage disposed thereon and a turns counter in communication therewith, the torque is monitored using the torque shaft, and the second connection is further monitored by measuring rotation of the torque shaft using the turns counter if the sudden change in torque is detected.

7. The method of claim 3, wherein the sudden change in torque is detected by calculating a differential of torque with respect to rotation or time and detecting a change in sign of the torque differential.

8. The method of claim 2, wherein the torque is monitored by calculating the torque from power input to the top drive.

9. The method of claim 2, wherein:

the second connection is between the quill and a torque shaft having a strain gage disposed thereon, and the torque is monitored using the torque shaft.

10. The method of claim 2, wherein the torque is monitored using an upper turns counter disposed near an upper longitudinal end of the first tubular and a lower turns counter disposed near a lower longitudinal end of the first tubular.

11. The method of claim 1, wherein the second connection is monitored by calculating a differential between rotation of the quill and rotation of the first tubular.

12. The method of claim 11, wherein the second connection is further monitored by calculating a differential between the torque exerted on the first tubular and a second torque exerted on the quill.

13. The method of claim 1, wherein:

the second connection is between the quill and a torque head or spear gripping the first tubular, and the second connection is monitored by calculating a differential between rotation of the quill and rotation of the torque head or spear.

14. The method of claim 13, wherein the second connection is further monitored by calculating a differential between the torque exerted on the tubular and a second torque exerted on the quill.

15. The method of claim 1, wherein:

the second connection is between the quill and a torque head or spear gripping the first tubular, hydraulic communication between the torque head or spear and a hydraulic pump is provided by a swivel, and a bearing is disposed between a housing and a shaft of the swivel, and the method further comprises:

determining acceptability of operation of the bearing by monitoring a torque exerted on the swivel housing by the bearing; and stopping operation of the top drive and/or notifying an operator of the top drive if the bearing operation is unacceptable.

16. The method of claim 15, wherein acceptability is further determined by comparing the swivel housing torque to the torque exerted on the first tubular.

17. A method of ensuring safe operation of a top drive, comprising:

operating a top drive, thereby rotating a quill of the top drive, wherein:

the quill of the top drive is connected to a torque head or a spear, hydraulic communication between the torque head or spear and a hydraulic pump is provided by a swivel, and a bearing is disposed between a housing and a shaft of the swivel, determining acceptability of operation of the bearing by monitoring a torque exerted on the swivel housing by the bearing; and stopping operation of the top drive and/or notifying an operator of the top drive if the bearing operation is unacceptable.

18. The method of claim 17, wherein acceptability is further determined by comparing the swivel housing torque to a torque exerted on the quill.

19. A torque head or spear for use with a top drive, comprising:

a body;

a gripping mechanism operably connected to the body for longitudinally and rotationally gripping a tubular;

a shaft connected to the body and having a threaded end for connection with a quill of the top drive;

a strain gage disposed on the shaft and operable to indicate torque exerted on the shaft by the quill; and a computer configured to perform an operation, comprising:

during operation of the top drive, monitoring for break-out of the connection; and stopping operation of the top drive and/or notifying an operator of the top drive if break-out of the connection is detected.

20. The torque head or spear of claim 19, further comprising a swivel, comprising:

a housing having a bracket for coupling the housing to a railing system of a drilling rig;

the shaft disposed in the housing; and a bearing disposed between the shaft and the housing.

21. The torque head or spear of claim 20, wherein the swivel further comprises:

a second strain gage disposed on the housing and operable to indicate torque exerted on the housing by the bearing, wherein the operation further comprises determining acceptability of operation of the bearing by monitoring the torque exerted on the swivel housing by the bearing; and stopping operation of the top drive and/or notifying an operator of the top drive if the bearing operation is unacceptable.

22. The torque head or spear of claim 20, wherein the swivel further comprises a turns counter operable to indicate rotation of the shaft.

23. A torque head or spear for use with a top drive, comprising:

a body;

a gripping mechanism operably connected to the body for longitudinally and rotationally gripping a tubular; and a swivel, comprising a housing having a bracket for coupling the housing to a railing system of a drilling rig;

a shaft disposed in the housing, and connected to the body, and having a threaded end for connection with a quill of the top drive;

a bearing disposed between the shaft and the housing; and a strain gage disposed on the housing and operable to indicate torque exerted on the housing by the bearing; and a computer configured to perform an operation, comprising:

determining acceptability of operation of the bearing by monitoring the torque exerted on the swivel housing by the bearing; and stopping operation of the top drive and/or notifying an operator of the top drive if the bearing operation is unacceptable.

* * * * *